US005260104A

United States Patent [19]

Bryant et al.

[11] Patent Number: 5,260,104

[45] Date of Patent: Nov. 9, 1993

[54] METHOD OF COATING ELONGATED FILAMENTS

[75] Inventors: Edward W. S. Bryant; Isaac T. Reidland, both of Lawrence, Kans.

[73] Assignee: Camco International Inc., Houston, Tex.

[21] Appl. No.: 981,785

[22] Filed: Nov. 25, 1992

[51] Int. Cl.[5] ..... B05D 3/06

[52] U.S. Cl. ..... 427/545; 427/120; 427/374.1; 427/374.2; 427/374.3; 427/386; 427/388.2; 427/398.3

[58] Field of Search ..... 427/117, 120, 374.1, 427/386, 388.1, 388.2, 398.1, 398.3, 374.2, 374.3, 545

[56] References Cited

U.S. PATENT DOCUMENTS 3,849,192 11/1974 Schmidt ..... 427/398.3 X
4,391,848 7/1983 Hilker ..... 427/120 X
4,606,870 8/1986 McGregor ..... 427/120 X
5,075,136 12/1991 Nield et al. ..... 427/398.3 X

*Primary Examiner*—Michael Lusignan

[57] ABSTRACT

A method and related apparatuses are disclosed for coating an elongated filament, such as wire, wherein wire is coated with a heated coating material, such as polyetheretherketone (PEEK), and the coated wire is maintained at a temperature and for a period of time sufficient for a desired quantity and size of crystals to form in the coating material and to minimize internal residual stress. Thereafter, the coated wire is rapidly cooled to a temperature below its crystallization temperature, such as in a quenching bath. A crystalline PEEK coating results which has minimized internal residual stress, is less brittle, and has improved cracking, peeling and abrasion resistance over amorphous PEEK coating obtainable using prior methods.

11 Claims, 2 Drawing Sheets

METHOD OF COATING ELONGATED FILAMENTS

BACKGROUND OF THE INVENTION

1. Field of the Invention

The present invention relates to methods of coating elongated filaments, such as wire, and, more particularly, to such a method that minimizes internal residual stress in the coating.

2. Description of Related Art

Elongated filaments, such as wire, are usually coated with material to protect the elongated filaments from the effects of deleterious environments, and/or to electrically insulate such elongated filaments. A problem encountered with certain coatings is that the coating process introduces stress into the coating material. This internal residual stress can cause undesired failure of the coating when the elongated filament is subjected to bending or torsional forces. Applied bending or twisting motion combined with the coating's internal residual stress causes it to become brittle, crack and peel. If the internal residual stress in the coating material could be minimized, the amount of applied stress needed to cause failure of the coating could be proportionally increased, which will result in a coating that is superior to previous coatings.

Illustrative methods of coating elongated filaments are disclosed in U.S. Pat. Nos. 4,391,848; 4,393,809; 4,394,417; and 4,489,130; however the issue of minimizing internal residual stress is not addressed therein.

Internal residual stress is caused when a plastic or polymerized material cools, in that the plastic cools from the outside inwardly and shrinks. This shrinkage, which is analogous to an increase in density, generates internal stresses in the plastic. Plastic coatings on wire have a special problem in that as the outer surface cools and solidifies, the still molten plastic (beneath a thin skin of cooled plastic) must shrink as it cools, and at the same time occupy the same volume because the outer skin is now a solid. Thus, this internal residual stress will result (on a microscopic level) in voids between the wire and the coating or within the coating itself. Polymers that tend to crystallize, such as polyetherketone (PEK) and polyetheretherketone (PEEK), exhibit this problem to a greater extent than noncrystalline coatings. Crystallization is a more ordered packing of the polymer chains, and consequently crystallized polymer coating occupy less volume and have a higher density than the noncrystallized portions of the polymer coating. Thus, a significant density gradient occurs at the interface of the microscopic crystals and the noncrystallized polymer coating.

An example of the above described problem of internal residual stress occurs with magnet wire used in the windings of electrical motors. Magnet wire is usually coated with a plastic coating material, such as PEK or PEEK, and is tightly wrapped as windings within the electric motor. Unfortunately, in the winding process the coating on the magnet wire can be mechanically damaged by improper bending and/or abrasion. Also, the magnet wires tend to rub against each other as the electric motor vibrates and the electric motor's internal temperature increases and decreases during operation. After many months of this rubbing, it has been found that the coating on the magnet wire becomes brittle, and minute cracks usually result. These cracks permit environmental agents to attack the now unprotected wire conductor causing hot spots, corrosion, and most troublesome, electrical shorting.

A more specific example of this problem is found when this prior type of magnet wire is used in an electric motor that powers an electric submergible pump (ESP) in a well. Such ESP's must operate without failure for years while submerged in wellbore fluids containing hydrogen sulfide and other chemical agents, as well as at temperatures oftentimes above 200 degrees F. When the coating on the magnet wire fails, as described above, the electric motor usually shorts and fails, the production of fluids from the well ceases, and a workover crew and equipment must remove the failed ESP and reinstall a replacement ESP. This failure results in lost oil production, which costs many thousands of dollars in lost revenue, and unnecessary associated ESP replacement costs.

There is a need for a method of coating elongated filaments with a coating that has superior characteristics to those obtainable using prior methods.

SUMMARY OF THE INVENTION

The present invention is contemplated to overcome the foregoing deficiencies and meet the above described needs. Specifically, the present invention is a method of coating an elongated filament with a coating material in a process that produces a crystalline coating that has superior characteristics to those obtainable from prior methods.

The method of the present invention generally comprises coating an elongated filament, such as wire, with a heated coating material. The heated coating material is concentrically applied to the wire, such as by an extruder and crosshead. After exiting the extruder and crosshead, the coating material is maintained at a temperature and for a period of time sufficient to form crystals therein of a desired quantity and size, and to minimize internal residual stress. These results are obtained by passing the coated elongated filament through a heater to keep the coating material above its glass transition temperature but below its melting point for a period of time to allow crystallization and permit internal stress to decrease. Thereafter, the coated elongated filament is cooled below its glass transition temperature in a sufficiently short period of time to create a crystalline coating with minimized internal residual stress. This cooling step can be accomplished by passing the coated elongated filament through a quenching bath.

The most commonly used prior coating methods, such as the methods described above as related art, melt the coating material in an extruder, pass the elongated filament through a crosshead where the melted coating material is applied, and then immediately quench the coated elongated filament. The inventors hereof have found that these prior methods do not permit the desired proper crystallization of the coating material, or if crystallization does occur, undesired relatively large crystals were formed therein which make the coating undesirably brittle. These prior methods create a coating with sufficient internal residual stress to oftentimes cause premature failure of the coating on magnet wire when used in electric motors for ESP's.

DETAILED DESCRIPTION OF THE PREFERRED EMBODIMENTS

As described above, the present invention is a method of coating an elongated filament in a manner that minimizes internal residual stress in the coating material. The inventors hereof have found that this coating is unexpectedly less brittle than that obtainable from prior methods, and has been found to exhibit superior resistance to cracking and abrasion. Briefly, the method of the present invention comprises: (a) coating an elongated filament with a coating material heated above its glass transition temperature, (b) maintaining the coated elongated filament at a temperature and for a period of time sufficient for crystals of a desired quantity and size to form in the coated material and for internal residual stress to be minimized, and (c) cooling the coated elongated filament below its glass transition temperature in a sufficiently short period of time to create a crystalline coating with minimized internal residual stress.

As used herein, the term "elongated filament" can refer to conductors, tubes, wires, bands, ropes, cable, strands, threads, and the like that are made from any desired material, such as metal, ceramic, glass and graphite. For the purposes of the following discussion, the elongated filament will be assumed to be a wire formed from copper or aluminum and used as magnet wire in an electric motor.

As used herein, the term "coating material" can refer to any flowable or meltable coating used to electrically insulate the elongated filament, and/or protect it from environmental agents. Examples of coating material contemplated for use within the present invention are polymers stabilized or curable by heat, including polyetherketone (PEK), polyetheretherketone (PEEK), polyetherketoneetherketoneketone (PEKEKK), polyamides, polyethylene terephthalates (PET), polysulphones, epoxies, polyesters, polyethers, polyketones, and other polymerizable combinations thereof. For the purposes of the following discussion, the coating material will be assumed to be polyetheretherketone (PEEK).

Method

Figure 1:
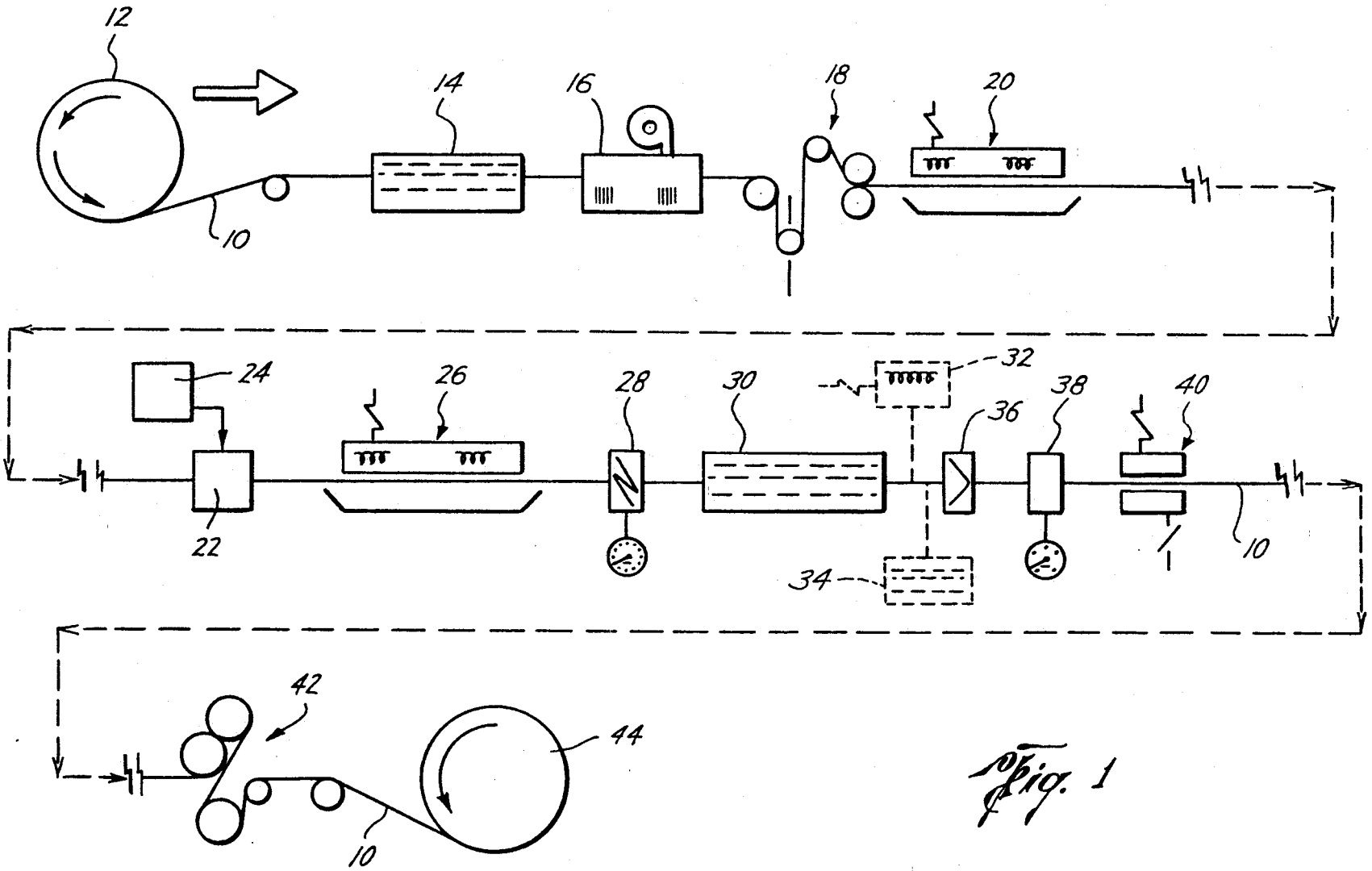
FIG. 1 is a diagrammatic representation of apparatuses, arranged in accordance with one preferred embodiment of the present invention, used to coat an elongated filament with a coating material.

The method of the present invention is preferably accomplished in continuous line process, as is well known to those skilled in the art, with various apparatuses needed for the process arranged linearly. One preferred arrangement of apparatuses is shown in FIG. 1, wherein wire 10 is fed from a play-out reel or drum 12, which is either free turning or rotated by an electric motor. The wire 10 is either annealed or unannealed, depending upon the diameter of the wire 10 to be coated. Smaller copper wire sizes, such as 12 AWG (0.0808"), are preferably made from unannealed copper to reduce the possibility of stretching the wire 10 during the coating process. Any commercially marketable wire sizes can be coated by this process, with wire sizes from about 0.17" dia. to about 0.005" dia. being the most commonly used sizes for magnet wire.

As the wire 10 moves off of the drum 12, it passes through a liquid bath 14 containing cleaning liquid, such as alcohol, a surfactant and/or water. The liquid can be at room temperature or it can be heated up to about 200 degrees F., as desired. The wire 10 is passed through an air dryer 16, which can be heated or unheated, to remove any remaining liquid. The liquid bath 14 and dryer 16 remove any residual oils and metal fines from the wire 10 prior to the application of the PEEK. The wire 10 is then passed through a tractor tension control device 18, as is well known to those skilled in the art, which ensures that the line speed and the tension in the wire 10 remain constant, since a constant line speed helps maintain a constant thickness of PEEK on the wire 10.

The wire 10 is preferably heated prior to the application of the PEEK by a heater 20, which can be a reflective, induction, conductive or radiant heater, but an induction heater is preferred. The wire 10 is preheated by the heater 20 to between about 300 degrees F. and about 800 degrees F. One of the primary considerations as to temperature is to ensure that the melted PEEK is hot enough to adhere to the wire 10 but not too high so as to sear the PEEK. If the wire 10 is not preheated, the heated PEEK will immediately crystallize upon contact with the relatively cool wire 10 and may be solidified (i.e. "frozen") in an undesired amorphous state. The desired preheat temperature depends on the type of coating material used, the diameter of the wire, the desired diameter of the coating, the line speed, the spacing of the apparatuses, etc. Therefore, certain routine experimentation is needed to determine the appropriate temperature, and is well within the skill of those reasonably skilled in the art.

The wire 10 exits the heater 20 and passes into a coating apparatus 22, wherein melted PEEK from a commercially available PEEK supply hopper and heater 24, is passed into an extruder and die which force the melted PEEK into the shape of a cone. This cone of melted PEEK is then drawn down around the wire 10 to the desired thickness of coating. Any desired type of commercially available coating apparatus can be used with the preferred methods of the present invention. A preferred coating apparatus is disclosed in U.S. Pat. No. 4,391,848; 4,393,809; 4,394,417; and 4,489,130, which are all herein incorporated by reference. The temperature of the melted coating material exiting the coating apparatus 22 depends on the type of coating material used, the diameter of the wire, the desired thickness of the coating, the line speed, the spacing of the apparatuses, etc. Therefore, certain routine experimentation is needed to determine the appropriate temperature, as is well within the skill of those reasonably skilled in the art. In one preferred embodiment of the present invention, the PEEK is heated to a temperature between about 500 degrees F. and about 800 degrees F., and most preferably to between about 675 degrees F. and about 800 degrees F.

As described earlier, one of the critical features of the present invention is to ensure that as the wire 10 exits the coating apparatus 22, the temperature of the PEEK is maintained within a desired range of temperatures and for a period of time sufficient to permit the desired quantity and size of crystals to form in the PEEK, and to minimize internal residual stress. If this period of time is too short before quenching, not enough of the desired sized crystals will form before the wire 10 is quenched or cooled to below its glass transition temperature. If too high of a temperature at the point of quenching, then the PEEK will remain amorphous or only relatively large crystals will form therein, which will cause the PEEK to become brittle. The desired quantity, distribution and size of spherulites or crystals required to minimize the internal residual stress and to be maintained in the resulting coating depend upon the type of coating material used, the thickness of the wire and the thickness of the coating. Therefore, certain routine experimentation is needed to determine the appropriate resulting crystalline structure.

The prior methods described earlier have the wire pass to a quenching bath immediately after exiting the coating apparatus. The inventors hereof have found that these prior methods do not permit the formation of the desired quantity and size of crystals. In fact, a majority of the time no crystals are formed so the resulting PEEK coating is referred to as "amorphous PEEK", which is characterized by being essentially clear. The inventors hereof have found that this amorphous PEEK does not have the desired resistance to cracking, peeling and abrasion for long time use as a coating on magnet wire used in electric motors for ESP's. On the other hand, the inventors hereof have found that the coating resulting from the practice of the preferred methods of the present invention (referred to as "crystalline PEEK") is characterized by being extremely tough (i.e. more resistant to cracking, peeling and abrasion than these prior coatings), and is characterized by being translucent pink to gray in color.

To create the desired crystalline PEEK coating, the wire 10 after exiting the coating apparatus 22 is passed through a secondary heater 26 to maintain the temperature of the PEEK at the desired temperature for a sufficient period of time to permit the desired quantity and size of crystals to form, and to minimize the internal residual stress. The secondary heater 26 can be a reflective, inductive, conductive or radiant heater, and preferably is a radiant over-type heater. The desired post-heat temperature must be above the glass transition temperature but below its melting temperature. Again, the desired time is a function of the line speed, the spacing of the apparatuses and the length of the secondary heater 26. In one preferred embodiment of the present invention, the PEEK coating in the secondary heater 26 is maintained at between about 200 degrees F. to about 650 degrees F. for a period of time of between about 4 seconds and about 35 seconds.

Alternately, the secondary heater 26 can be eliminated if the temperature of the heated coating material is sufficiently high enough so as to not decline below its glass transition temperature in the period of time needed to permit the formation of the desired quantity and size of crystals, and needed to minimize the internal residual stress prior to quenching.

Continuing with the process, the exterior diameter of the coated wire 10 is measured by an optical gauge detector 28, and the wire 10 is passed into a quenching bath 30, wherein the wire 10 is rapidly cooled to below the glass transition temperature, and usually to about room temperature. The quenching bath 30 of one preferred embodiment of the present invention contains water or other suitable liquid initially at room temperature, or the liquid can be chilled to be initially below room temperature, as is desired.

Optionally, an auxiliary heater 32 and auxiliary quenching bath 34 can be added to the line after the quenching bath 30 to further ensure that the desired quantity and size of crystals are formed and the internal residual stress is minimized in the coating. The auxiliary heater 32 can be a reflective, induction, conduction or radiant heater, and preferably is a radiant oven heater. The auxiliary heater 32 raises the temperature of the PEEK coated wire to above its glass transition temperature and below its melting temperature. In one preferred embodiment of the present invention, the wire 10 is heated to between about 200 degrees F. and about 500 degrees F. for a period of time of between about 4 seconds and about 35 seconds. The reheated, coated wire 10 is then passed into the auxiliary quenching bath 34 to rapidly lower the temperature of the wire 10, for the reasons stated above.

Finally, the wire 10 now has a centering check performed by a concentricity monitor 36, an optical or mechanical diameter/gauge measuring device 38 checks the exterior diameter of the coated wire 10, and a spark detector 40 is used to determine if any voids are present in the PEEK. An accumulator 42 temporarily gathers the wire 10, prior to the wire 10 being collected on a take-up reel or drum 44, so that the line can continue to run when a drum 44 is changed, as are all well known to those skilled in the art.

One preferred implementation of the process and linear arrangement of the apparatuses of the present invention is as follows. #6.5 (0.1527" dia.) AWG unannealed bare copper wire was to be coated with PEEK 381G from Victrex Corp. The PEEK was first heated to 350 degrees F. in a commercially available PEEK supply hopper and heater 24. The wire was then preheated to 475 degrees F. when it passed through a 5 foot long induction heater 20. The wire was fed at a line speed of 50 feet per minute through a commercially available extruder/crosshead, coating apparatus 22 wherein a 0.1647" (0.006" wall thickness) PEEK coating was applied. The coated wire was thereafter reheated to about 500 degrees F. when it passed through a 144" long radiant oven-type heater 26, with the distance travelled from the crosshead (not shown) in the coating apparatus 22 to the heater 26 being 29". Thereafter, the wire moved a distance of 13" before entering a 65" long quenching bath 30, containing tap water initially at room temperature. All samples of the PEEK-coated wire made hereby exhibited the grayish pink color characteristic of the desired crystalline PEEK, and showed no signs of cracking or peeling after being bent by hand.

Tests

A simple stress test was conducted to illustrate that wire coated with PEEK in accordance with the above described preferred methods is more resistant to cracking and peeling than wire coated with amorphous PEEK (made using the prior methods). For the test, the inventors obtained from Phelps Dodge #8 AWG copper wire coated with amorphous PEEK, which the inventors believe was coated using the methods described in U.S. Pat. Nos. 4,391,848; 4,393,809; 4,934,417; and 4,489,130. Another sample of #8 AWG copper wire was coated with crystalline PEEK, using the preferred methods described above. The PEEK on both samples of wire coatings were approximately 0.006" dia. in radial thickness, and the wires were cut into 8" samples. The samples were bent by hand 180 degrees into a U-shape with bend diameters of 0.5", 0.75" and 1.0". Groups of the samples were placed in a 2,000 milliliter (ml) pressure vessel containing about 1,000 ml of distilled water. The vessel was sealed and the internal temperature raised to about 530 degrees F at 600 psi for 18 hours. The pressure vessel was cooled and opened. Each sample was unbent and straightened by hand, and visually inspected using a 10×microscope.

Figure 2:
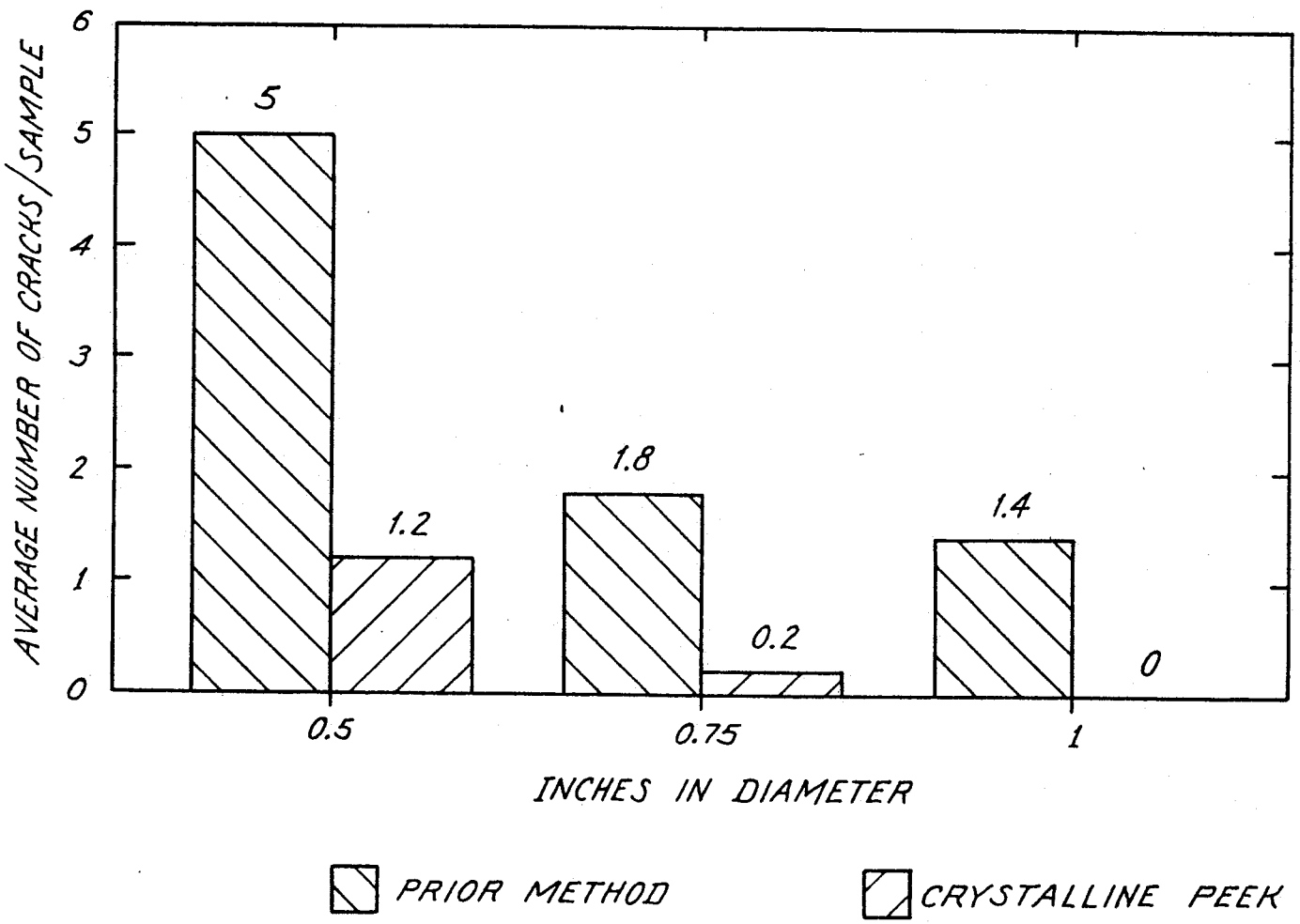
FIG. 2 is a graphical representation of the results of stress tests on wire coated with a prior method and wire coated in accordance with one preferred method of the present invention.

The results of the test are shown in FIG. 2, wherein the wire coated with crystalline PEEK and bent to 1.0" had no cracks per 5" sample, which is an excellent result as compared to the amorphous PEEK which had an average of about 1.4 cracks per 5" sample. The significance of this is that the usual minimum bend in an electric motor for use with an ESP is about 1.5" and a 1.0" bend is a good test with sufficient safety factor. The fact that no cracks were found in the crystalline PEEK means that the likelihood of shorting and electric motor failure has been significantly reduced. The 400%-500% reduction in cracks for the crystalline PEEK 0.5" and the 0.75" bends means that it may be possible to design higher efficiency, smaller electric motors with the same size of magnet wire as the larger electric motors without the concern for overbending and cracking the coating material on the magnet wire.

Whereas the present invention has been described in particular relation to the drawings attached hereto and tests described herein, it should be understood that other and further modifications, apart from those shown or suggested herein, may be made within the scope and spirit of the present invention.

What is claimed is:

1. A method of coating an elongated filament in a manner to minimize internal residual stress, comprising:
(a) heating an elongated filament;
(b) coating the elongated filament with a coating material, which is heated above its glass transition temperature;
(c) maintaining the coated elongated filament at a temperature and for a period of time sufficient to form crystals in the coating material and to minimize internal residual stress; and
(d) cooling the coated elongated filament below its crystallization temperature in a sufficiently short period of time to create a crystalline coating with minimized internal residual stress.

2. The method of claim 1 wherein the elongated filament is metal wire.

3. The method of claim 1 wherein the coating material is selected from the group consisting of, polyamides, polysulphones, epoxies, polyesters, polyethers, polyketones, and polymerizable combinations thereof.

4. The method of claim 1 wherein step (c) further comprises passing the coated elongated filament through a quenching bath.

5. The method of claim 1 wherein the elongated filament is heated to a temperature of between about 300 degrees F. and about 800 degrees F. prior to step (b).

6. The method of claim 1 wherein the coating material in step (b) is heated to between about 500 degrees F. and about 800 degrees F.

7. The method of claim 1 wherein step (c) further comprises passing the coated elongated filament through a radiant heater.

8. The method of claim 1 wherein step (c) further comprises heating the coated elongated filament to a temperature of between about 200 degrees F. and about 650 degrees F. for between about 4 seconds and about 35 seconds.

9. The method of claim 1 and further including:
(e) reheating the coated elongated filament to a temperature and for a period of time sufficient to form crystals in the coating material and minimize internal residual stress; and
(f) cooling the reheated coated elongated filament to a temperature below its glass transition temperature and to minimize internal residual stress.

10. The method of claim 9 wherein step (e) further comprises reheating the coated elongated filament to a temperature of between about 200 degrees F. and 500 degrees F. for a period of time of between about 4 seconds and about 35 seconds.

11. The method of claim 9 wherein step (f) further comprises passing the reheated coated elongated filament through a quenching bath.

* * * * *